US008790122B2

(12) United States Patent
Malehorn, II et al.

(10) Patent No.: US 8,790,122 B2
(45) Date of Patent: Jul. 29, 2014

(54) ELECTRICAL CONNECTOR HAVING IMPROVED HOUSING

(75) Inventors: Richard Lee Malehorn, II, York, PA (US); Terrance F. Little, Fullerton, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 155 days.

(21) Appl. No.: 13/565,731

(22) Filed: Aug. 2, 2012

(65) Prior Publication Data

US 2013/0337695 A1 Dec. 19, 2013

Related U.S. Application Data

(63) Continuation-in-part of application No. 13/526,538, filed on Jun. 19, 2012.

(51) Int. Cl.
*H01R 12/00* (2006.01)
*H01R 12/57* (2011.01)
*H01R 24/18* (2006.01)

(52) U.S. Cl.
CPC ..... *H01R 12/57* (2013.01); *H01R 23/27* (2013.01)
USPC ..... 439/83

(58) Field of Classification Search
CPC ..... H01R 12/57; H01R 23/75; H01R 23/27
USPC ..... 439/83, 74, 284, 291
See application file for complete search history.

(56) References Cited

U.S. PATENT DOCUMENTS

| | | | | |
|---|---|---|---|---|
| 5,836,773 | A * | 11/1998 | McHugh et al. | 439/74 |
| 5,885,092 | A * | 3/1999 | Ito et al. | 439/74 |
| 6,338,630 | B1 * | 1/2002 | Dong | 439/74 |
| 6,379,170 | B1 | 4/2002 | Czeschka et al. | |
| 6,793,506 | B1 * | 9/2004 | Hirata et al. | 439/74 |
| 6,827,588 | B1 * | 12/2004 | Huang et al. | 439/74 |
| 6,881,075 | B2 * | 4/2005 | Huang et al. | 439/74 |
| 7,090,508 | B1 * | 8/2006 | Chen | 439/74 |
| 7,172,433 | B2 * | 2/2007 | Tsai | 439/74 |
| 7,287,988 | B1 * | 10/2007 | Peng et al. | 439/74 |
| 7,371,079 | B2 * | 5/2008 | Yang et al. | 439/74 |
| 7,547,236 | B1 * | 6/2009 | Chen | 439/660 |
| 7,553,167 | B2 * | 6/2009 | Zhang et al. | 439/74 |
| 7,677,903 | B1 * | 3/2010 | Huang et al. | 439/74 |
| 7,789,673 | B2 * | 9/2010 | Lee et al. | 439/74 |
| 7,798,836 | B2 * | 9/2010 | Lappoehn | 439/291 |
| 8,337,218 | B2 * | 12/2012 | Hirata et al. | 439/83 |
| 2009/0081903 | A1 * | 3/2009 | Zhang et al. | 439/626 |
| 2013/0337681 | A1 * | 12/2013 | Little et al. | 439/569 |

* cited by examiner

*Primary Examiner* — Neil Abrams
(74) *Attorney, Agent, or Firm* — Ming Chieh Chang; Wei Te Chung

(57) ABSTRACT

An electrical connector (100) includes a housing (1) and a number of terminals (2). The housing includes a floor (10) having a number of bar sections (19) and a number of passageways (16) arranged alternately along a lengthwise direction. The floor has an outwardly exposed bottom face (101) tapered with respect to an imaginary center line thereof to improve mold flow process. The number of terminals are secured in the corresponding passageways. Each terminal has a contacting section. The housing has additional wall section thickness well within the product height requirement.

16 Claims, 6 Drawing Sheets

ELECTRICAL CONNECTOR HAVING IMPROVED HOUSING

CROSS-REFERENCE TO RELATED APPLICATIONS

This patent application is related to U.S. patent application Ser. No. 13/315,549, filed on Dec. 9, 2011, entitled "HERMAPHRODITIC BOARD TO BOARD CONNECTOR AND ASSEMBLY THEREOF WITH OFFSET CONTACT ARRANGEMENT", U.S. Design patent application Ser. No. 29/417,994, filed on Apr. 11, 2012, and Ser. No. 29/417,995, filed on Apr. 11, 2012, both entitled "ELECTRICAL CONNECTOR," and is a continuation-in-part of U.S. patent application Ser. No. 13/526,538, filed on Jun. 19, 2012, entitled "BOARD TO BOARD CONNECTOR WITH ENHANCED METAL LOCKING FEATURES" and U.S. patent application Ser. No. 13/565,730, filed on Aug. 2, 2012, entitled "ELECTRICAL CONNECTOR ASSEMBLY FOR BLIND MATING", which are assigned to the same assignee with this application.

BACKGROUND OF THE INVENTION

1. Field of the Invention

The present invention relates to an electrical connector, and more particularly to a board to board connector capable of mating with another board to board connector for electrical connection between two circuit boards.

2. Description of Related Art

U.S. Patent Application Publication No. 2009/0081903 published on Mar. 26, 2009 discloses a board to board connector including a female connector and a male connector having a same configuration. Each of the male connector and the female connector has a housing and a plurality of terminals mounted in the housing. Each terminal has a body portion, a curved resilient contacting arm, a vertical stiff contacting arm, and a pair of tail portions extending outwardly from opposite ends of the body portion. The stiff contacting arm of the male connector is sandwiched between the resilient contacting arm and the stiff contacting arm of the female connector. The resilient contacting arm of the male connector contacts with the stiff contacting arm of the female connector. Each housing includes a flat floor having a plurality of straight bar sections and a plurality of recesses arranged alternately.

An electrical connector having an improved housing is desired.

SUMMARY OF THE INVENTION

Accordingly, an object of the present invention is to provide an electrical connector comprising a strengthened housing having additional wall thickness within the product height requirement.

In order to achieve the object set forth, an electrical connector includes a housing and a plurality of terminals. The housing comprises a floor having a plurality of bar sections and a plurality of passageways arranged alternately along a lengthwise direction. The floor has an outwardly exposed bottom face tapered with respect to an imaginary center line thereof. The plurality of terminals are secured in the corresponding passageways. Each terminal has a contacting section.

The thickness of the floor about the imaginary center line has been increased due to the tapered configuration. The tapered floor would reduce current injection pressure per mold flow and improve mold flow process.

Other objects, advantages and novel features of the invention will become more apparent from the following detailed description when taken in conjunction with the accompanying drawings.

DETAILED DESCRIPTION OF THE PREFERRED EMBODIMENT

Figure 1:
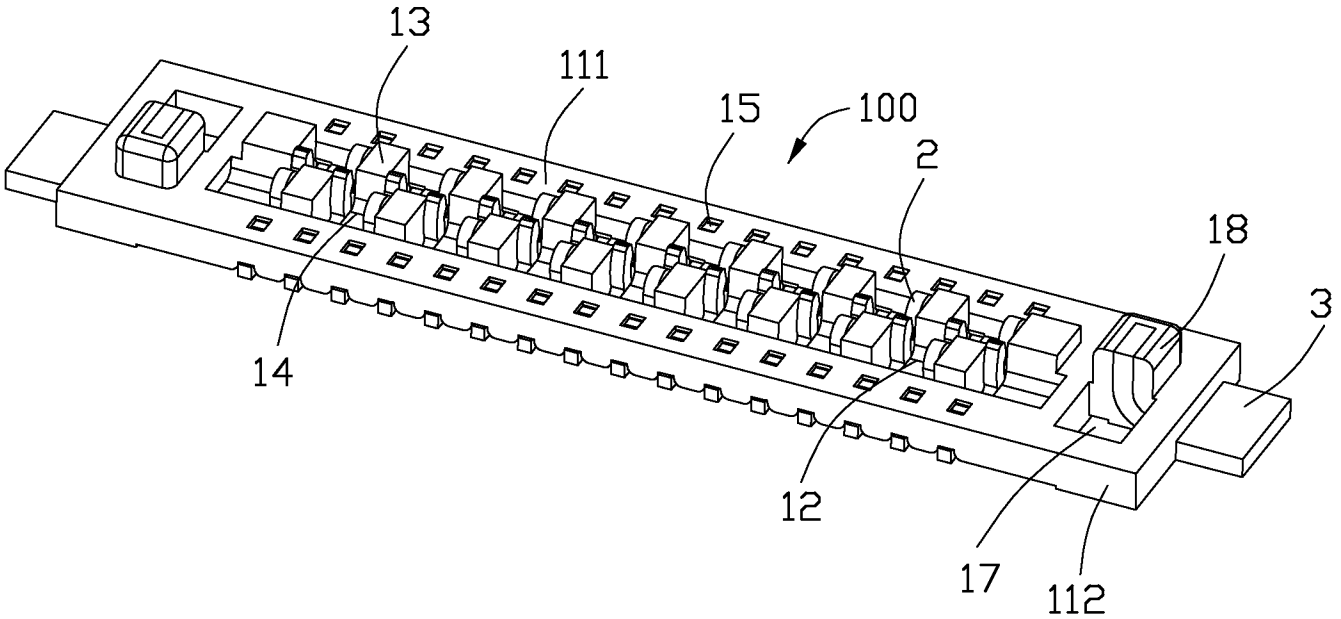
FIG. 1 is an assembled perspective view showing an electrical connector in accordance with the present invention.
Figure 2:
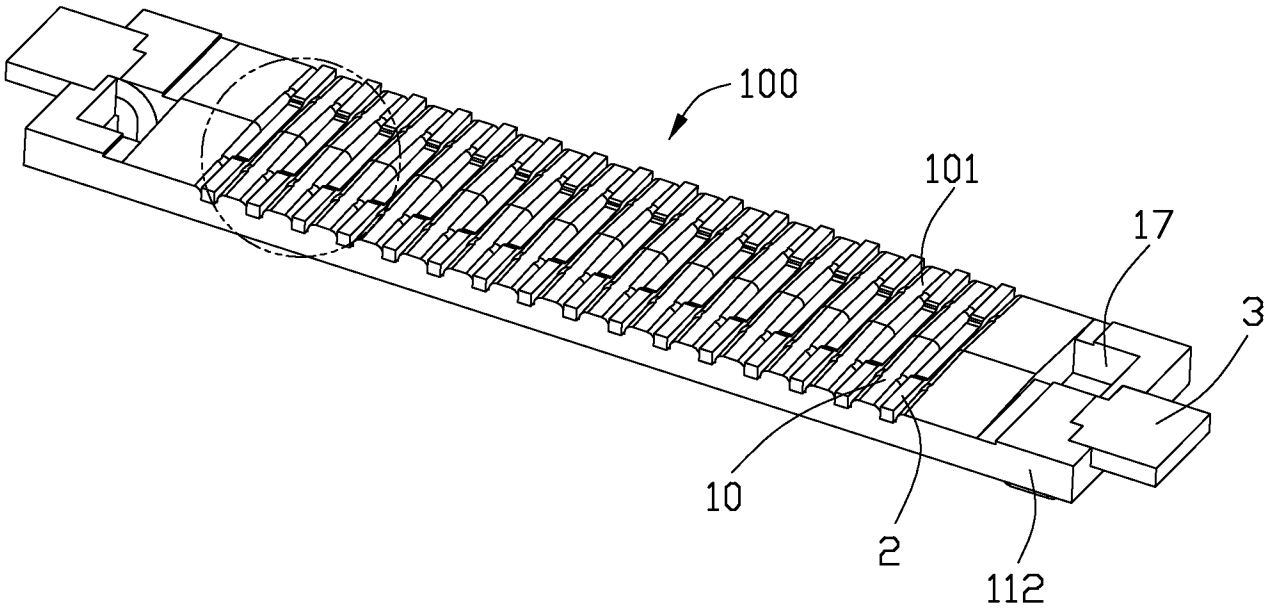
FIG. 2 is another assembled perspective view similar to FIG. 1, taken from another aspect.
Figure 3:
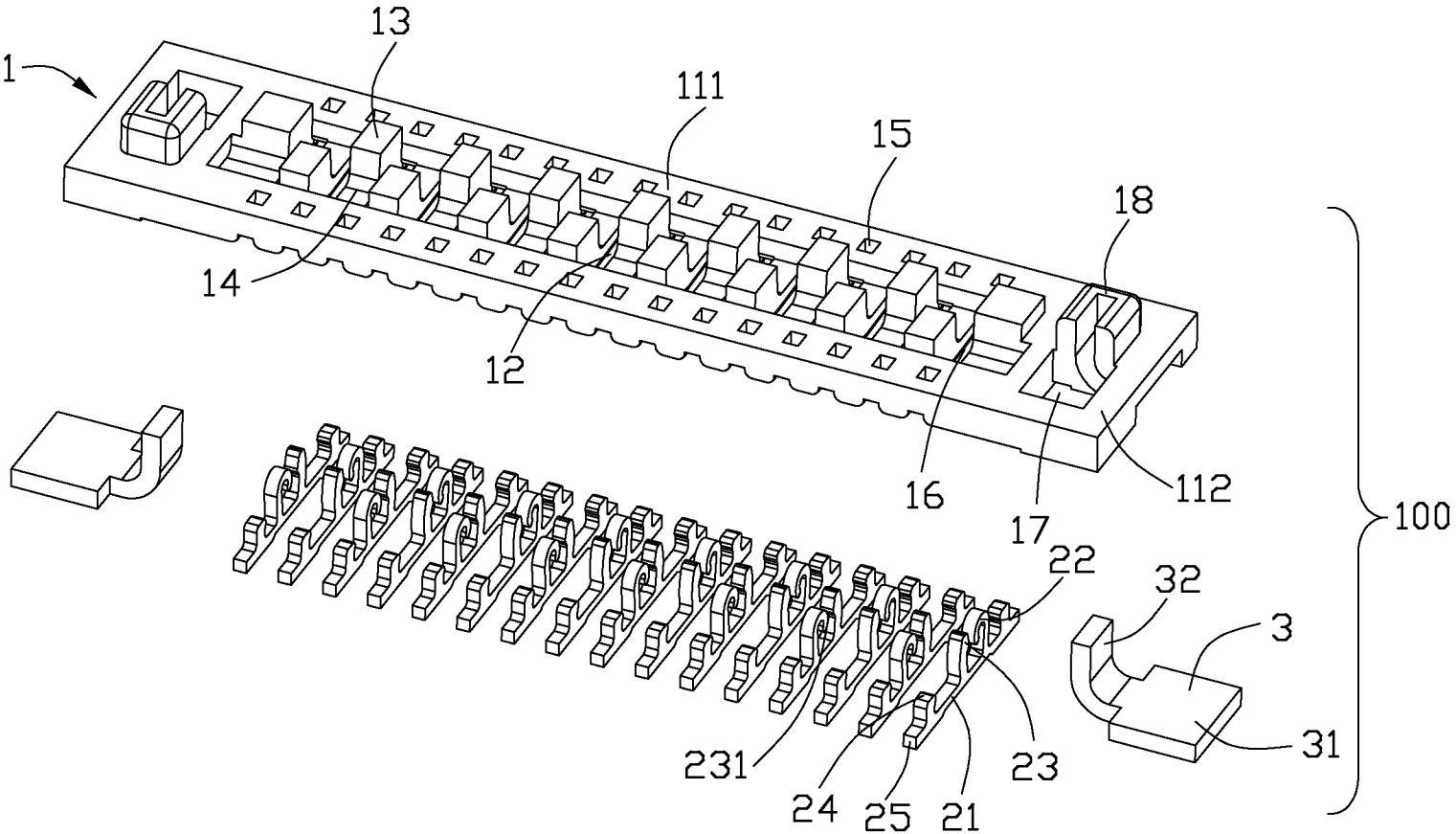
FIG. 3 is an exploded view showing the electrical connector.
Figure 4:
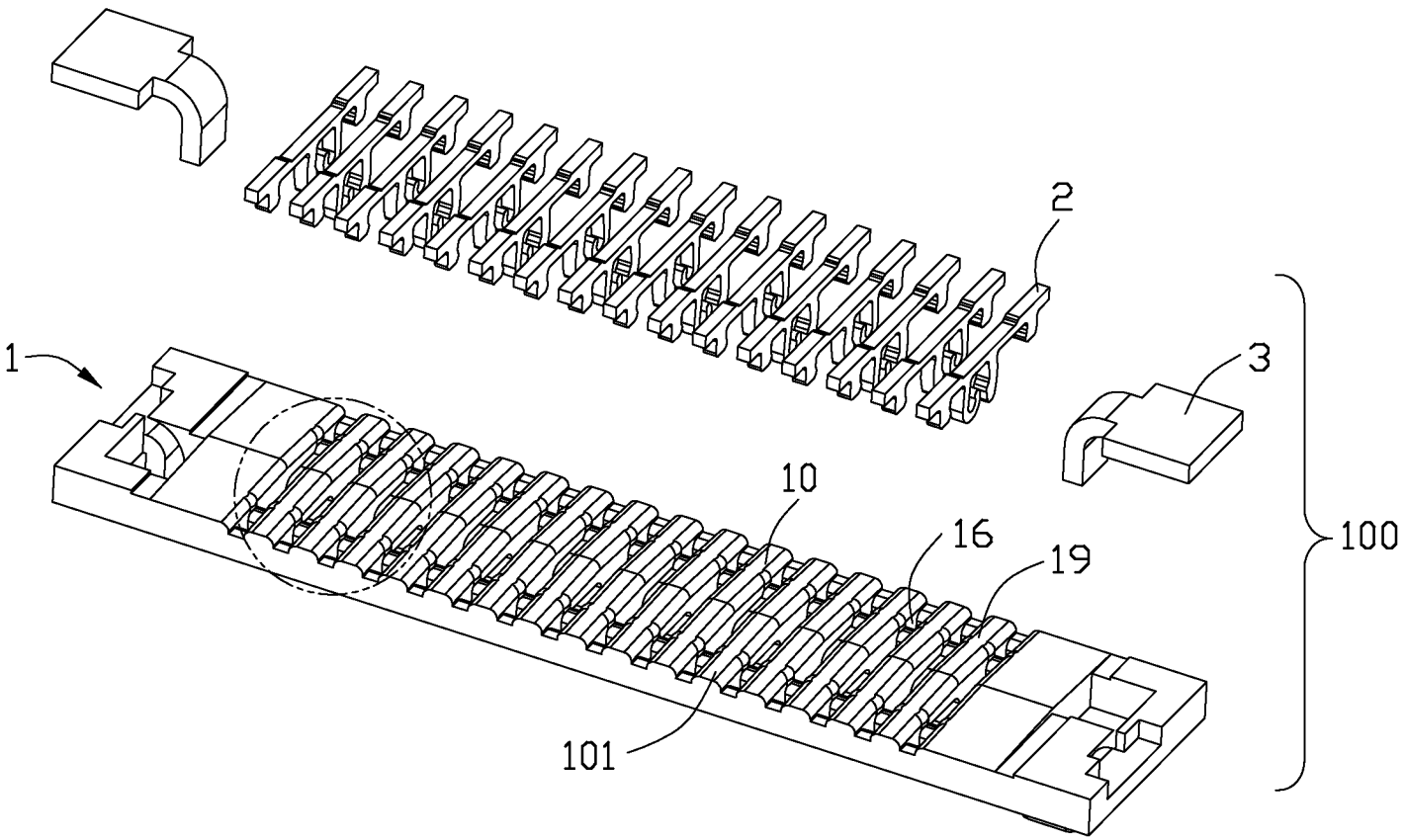
FIG. 4 is another exploded view similar to FIG. 3, taken from another aspect.
Figure 5:
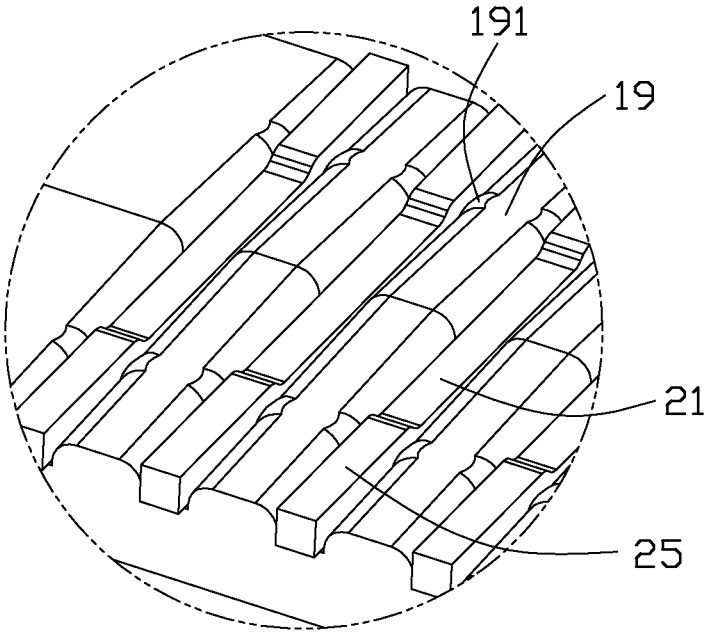
FIG. 5 is an enlarged perspective view of a part of the assembled electrical connector marked in FIG. 2.
Figure 6:
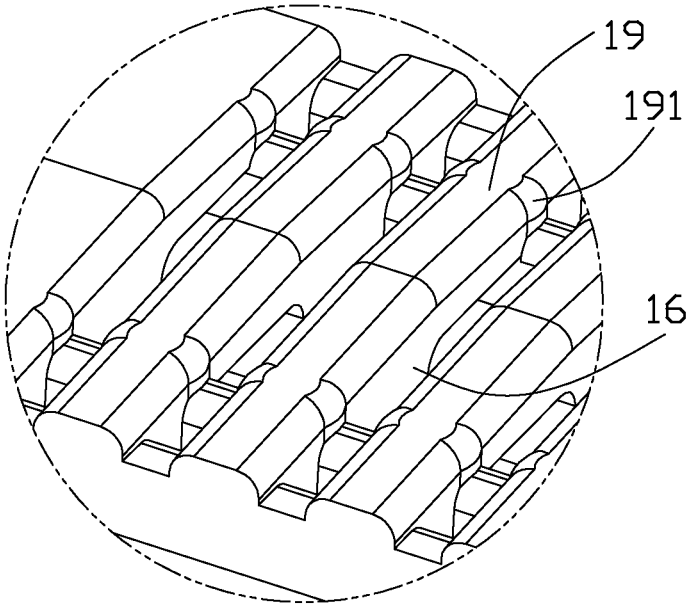
FIG. 6 is an enlarged perspective view of a part of the housing marked in FIG. 4.

Reference will now be made in detail to the preferred embodiment of the present invention. Referring to FIGS. 1-6, an electrical connector 100 is capable of mating with another electrical connector (not shown) for electrical connection between two circuit boards (not shown).

The electrical connector 100 includes a housing 1, a plurality of terminals 2 secured in the housing 1 and a pair of mounting sections 3.

The housing 1 comprises a floor or bottom face 10, a lake portion 12 above the floor 10, a pair of side walls 111, a pair of end portions 112 surrounding the lake portion 12. The floor 10 has a plurality of bar sections 19 and a plurality of passageways 16 arranged alternately along a lengthwise direction. Each passageway 16 extends through the floor 10. The floor 10 has an outwardly exposed bottom face 101 tapered with respect to an imaginary center line thereof. The thickness of the floor 10 about the imaginary center line has been increased due to the tapered configuration. The tapered floor 10 would reduce current injection pressure per mold flow and improve mold flow process.

Each bar section 19 has two pairs of outwardly protruding retention portions 191 projecting oppositely along the lengthwise direction toward two adjacent passageways 16. The two pairs of retentions portions 191 on a same bar section 19 are symmetrically formed with respect to the imaginary center line of the floor 10. Each retention portion 191 has a curved contour. The conventional two adjacent bar sections without retention portions would interfere with the terminal 2 by side edges of the bar sections. It is hard to sandwich the terminal between the two bar sections. The terminal 2 would be sandwiched more tightly and fixed more reliably via the retention portions 191 applied in this embodiment. It would be helpful to promote better contact centering results during the product assembly. A width of the bar section 19 at the retention portions 191 is larger than that of the bar section 19 at other positions. Compared to the conventional bar section without retention portions, it could provide more surface area at the retention portions 191 in this embodiment for standard ejector pins (not shown) to complete the molding cycle.

The housing 1 has a plurality of standoffs 13 standing upwardly from the lake portion 12, and a plurality of indentations 14 each beside and aligned with the corresponding standoff 13 along a width direction. Two adjacent standoffs 13 are staggered for assured complete contact protection and blind mating. The housing 1 further has a plurality of slits 15 defined in each side wall 111. Each end portion 112 includes a guiding post 18 and a guiding hole 17 beside the guiding post 18.

Each terminal 2 includes a body portion 21, a pair of tail portions 25 extending from opposite ends of the body portion 21, a pair of barb portions 24 respectively standing on the pair of tail portions 25, and a contacting section (not labeled) between the pair of barb portions 24. The contacting section of each terminal 2 comprises a stiff contacting arm 23 having a hook portion 231 and a curved resilient contacting arm 22 having a free end bent toward the stiff contacting arm 23. Each tail portion 25 has a flat outer surface for being surface mounted or soldered on the circuit board. In this embodiment, two adjacent terminals 2 are formed symmetrically with respect to an imaginary line of the terminal 2, with the contacting sections of the two adjacent terminals 2 staggered. Optionally, all of the terminals 2 could be configured identically.

Each mounting section 3 includes an inserting portion 32 molded with the guiding post 18 and a mounting portion 31 mounted on the circuit board.

In assembling of the electrical connector 100, each terminal 2 is mounted into the passageway 16 from a bottom-to-up direction, with the body portion 21 exposed outwardly of the floor 10 of the housing 1. The pair of barb portions 24 of each terminal 2 are secured in the pair of slits 15. The standoffs 13 are resisted against by the contacting sections of the terminals 2. The pair of retention portions 3 are insert molded with the housing 1 for being surface mounted or soldered on the circuit board.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing including a floor having a plurality of bar sections and a plurality of passageways arranged alternately along a lengthwise direction, said floor having an outwardly exposed bottom face tapered with respect to an imaginary center line thereof; and a plurality of terminals secured in corresponding passageways, each terminal having a contacting section.

2. The electrical connector as claimed in claim 1, wherein each passageway extends through the bottom face of the floor, and each terminal is mounted into a corresponding passageway from a bottom-to-up direction.

3. The electrical connector as claimed in claim 1, wherein each bar section has a pair of retention portions projecting oppositely along the lengthwise direction toward two adjacent passageways, a width of the bar section at the retention portions being larger than that of the bar section at other positions.

4. The electrical connector as claimed in claim 3, wherein each bar section has another pair of retention portions projecting oppositely toward two adjacent passageways, said two pairs of retentions portions being respectively disposed at opposite sides of the imaginary center line of the floor.

5. The electrical connector as claimed in claim 3, wherein each retention portion has a curved contour.

6. The electrical connector as claimed in claim 3, wherein each terminal has a body portion disposed between two adjacent bar sections and sandwiched between the retention portions of that two adjacent bar sections.

7. The electrical connector assembly as claimed in claim 6, wherein said housing comprises a pair of side walls respectively defining a plurality of slits, and each terminal includes a pair of tail portions extending from opposite ends of the body portion and exposed outwardly through the passageway, and a pair of barb portions respectively extending vertically from the pair of tail portions and secured in two corresponding slits.

8. The electrical connector assembly as claimed in claim 7, wherein said housing comprises a pair of end portions connected with the pair of side walls, each end portion includes a guiding post and a guiding hole beside the guiding post, and said electrical connector comprises a pair of mounting sections each having an inserting portion molded with the guiding post and a mounting portion mounted on a circuit board.

9. The electrical connector as claimed in claim 1, wherein said housing includes a plurality of standoffs resisted against by the terminals, two adjacent standoffs being staggered with each other.

10. The electrical connector as claimed in claim 1, wherein said contacting section of each terminal comprises a stiff contacting arm and a curved resilient contacting arm having a free end bent toward the stiff contacting arm.

11. An electrical connector comprising:

a housing including a floor having a plurality of bar sections and a plurality of passageways arranged alternately along a lengthwise direction, each bar section having a pair of retention portions projecting oppositely along the lengthwise direction toward two adjacent passageways; and a plurality of terminals secured in corresponding passageways, each terminal having a contacting section and a body portion sandwiched between the retention portions of two adjacent bar sections.

12. An electrical connector comprising:

an insulative housing defining a lengthwise direction and a transverse direction perpendicular to each other;

a plurality of passageways and a plurality of bar sections being alternately arranged along said lengthwise direction;

a plurality of contacts dispose din the corresponding passageways, respectively, each of said contacts being directly stamped from sheet metal with a final configuration thereof without further bending, said final configuration defining a horizontal body portion with at least one horizontal tail portion at one end in a downward offset manner with regard to the body portion in a vertical direction; and a bottom face of the housing defined by the bar sections and defining a lower center region and a higher periphery region; wherein the lower center region is lower than the horizontal body portion to hide the horizontal body portion around a lengthwise centerline of the housing along the lengthwise direction while the higher periphery region is at least partially higher than the horizontal tail potion to expose at least partially the horizontal tail portion along the lengthwise direction.

13. The electrical connector as claimed in claim 12, wherein a barb portion upwardly extends from the horizontal tail portion to interfere with the housing to retaining the contact to the housing.

14. The electrical connector as claimed in claim 12, wherein each of the bar sections defines a pair of outwardly protruding retention portions opposite to each other in the lengthwise direction and into the corresponding two adjacent passageways to retain the tail portions of the corresponding two adjacent contacts, respectively.

15. The electrical connector as claimed in claim 12, wherein said pair of outwardly protruding retention portions are spaced from a corresponding side edge of the housing.

16. The electrical connector as claimed in claim 12, wherein the bottom face extends in an oblique plane.

* * * * *